United States Patent [19]

Wroble

[11] Patent Number: 4,501,188

[45] Date of Patent: Feb. 26, 1985

[54] REMOTE CONTROL SYSTEM

[75] Inventor: Arthur J. Wroble, Grosse Pointe Shores, Mich.

[73] Assignee: Ex-Cell-O Corporation, Troy, Mich.

[21] Appl. No.: 436,170

[22] Filed: Oct. 22, 1982

[51] Int. Cl.[3] ..... F41G 5/16; F41G 1/00

[52] U.S. Cl. ..... 89/41 M

[58] Field of Search ..... 89/41 M, 41 MC, 41 ME, 89/41 E, 41 LE, 41 T, 42 B, 42 R

[56] References Cited

U.S. PATENT DOCUMENTS

| | | | |
|---|---|---|---|
| 3,309,963 | 3/1967 | Salomonsson | 89/41 LE |
| 3,566,743 | 3/1971 | Frohock | 89/41 E |
| 4,172,409 | 10/1979 | Loos et al. | 89/41 E |

*Primary Examiner*—Stephen C. Bentley
*Assistant Examiner*—Tyrone Davis
*Attorney, Agent, or Firm*—John C. Evans

[57] ABSTRACT

A vehicle mounted weapons control system has forward feed provided by a stepping motor drive system under the control of an analog controller without feedback from the weapons system. The controller includes a ballistic computer to produce outputs of train and elevation rates and stabilization means that includes means to modify the aforesaid rates to counteract vehicle disturbances and means to provide stabilization train and elevation rate signals which combine with the ballistic computer outputs to produce analog signals for use in controlling the rate of pulses generated in the stepping motor drives.

2 Claims, 4 Drawing Figures

REMOTE CONTROL SYSTEM

BRIEF SUMMARY

This invention relates to remote control of actuated devices. A field of use to which it is particularly suited is that of aiming a weapon mounted on a moving platform to keep the weapon on target. A specific example of this, to which the following detailed description is devoted, is that of aiming a weapon (called a gun for brevity) which is mounted upon a moving vehicle (called a tank for brevity).

In such a situation, the ballistic problems have long been attacked with fair success. However, the problem of stabilizing the gun and its sight to keep them on target notwithstanding vehicle yaw, roll, and pitch (which may be quite abrupt) presents great difficulties.

It has been customary to transmit train (azimuth) and elevation command signals, and sometimes range information, to the gun mount. Feedback from the gun to the source of these commands has been relied upon to enforce compliance with the commands. However, this is not wholly satisfactory. For feedback to initiate compliance, there must be an error between input and response. More significant, however, is the fact that the stability of feedback control is prejudiced, and may be defeated, by changes in dynamics of the mechanism. For example, development of excessive friction may prevent sufficiently accurate tracking, and the source of such errors may be hard to find.

It is proposed here, therefore, to abandon automated feedbacks. Instead, the forward feed of orders to the gun is effected by stepping motor systems. These have the rigorous compliance to command inherent in digital systems. Only an overload which stalls the stepping motor, and which is thus immediately apparent, interrupts accurate response to inputs.

It is also proposed here to improve the system of control of the stepping motors to minimize the likelihood of drop-out from overload. This involves limiting the rate of acceleration of the stepping motor as a function of its speed so as to achieve maximum ability to follow abrupt vehicle transients while avoiding drop-out or stalling of the drives to the weapon and gun sight.

The nature of this invention will be clearly apparent from the succeeding detailed description of its preferred embodiment and the appended claims.

THE DRAWINGS

DETAILED DESCRIPTION

Figure 1:
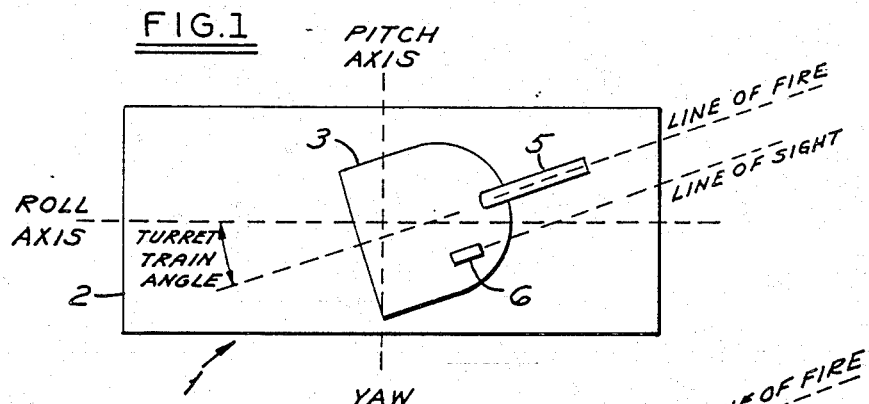
FIGS. 1 and 2 are diagrammatic plan and elevation views of a tank gun installation.
Figure 2:
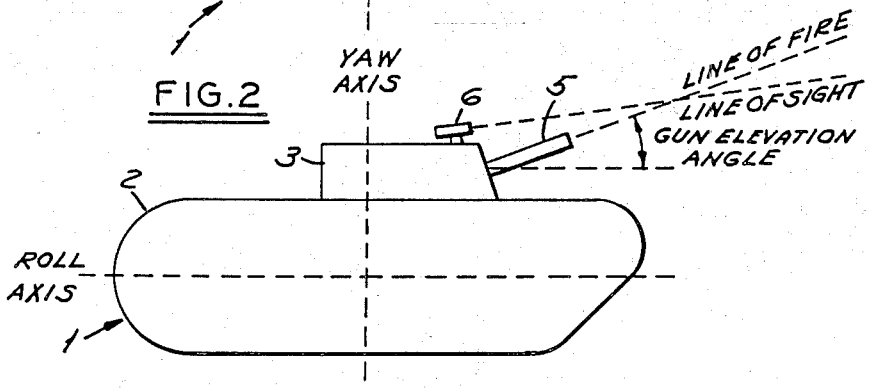

Referring to the drawings, a vehicle such as a tank 1 includes a hull 2 which mounts a gun turret 3 rotatable in train about a vertical axis. A gun 5 is mounted in the turrent for elevation about a horizontal axis. A gun sight 6, which may be mounted on or in the turret, is used by a gunner to track a target. The sight is moved in train and elevation with the gun, and additionally is offset in azimuth to establish a horizontal lead angle between the gun bore and the line of sight, and offset in elevation to establish superelevation of the gun bore relative to the line of sight. A gunner operates controls (not shown here) to track the target with the sight and, indirectly through a computer, aim the gun. The weapon 5 might be something other than a gun.

For the tank to fire effectively while moving it is necessary to stabilize the sight and gun; that is, compensate for transients of orientation of the tank. These transients are defined as yaw, rotation about an axis vertical to the hull; roll, rotation about an axis lengthwise of the hull; and pitch, rotation about an axis crosswise of the hull. These axes are mutually perpendicular. The yaw axis can be taken to coincide with the axis of rotation of the turret. By compensating for such disturbances, the sight and the gun are maintained steady in their aim, and the gunner needs only to provide inputs to compensate for changes due to tank and target translation.

Figure 3:
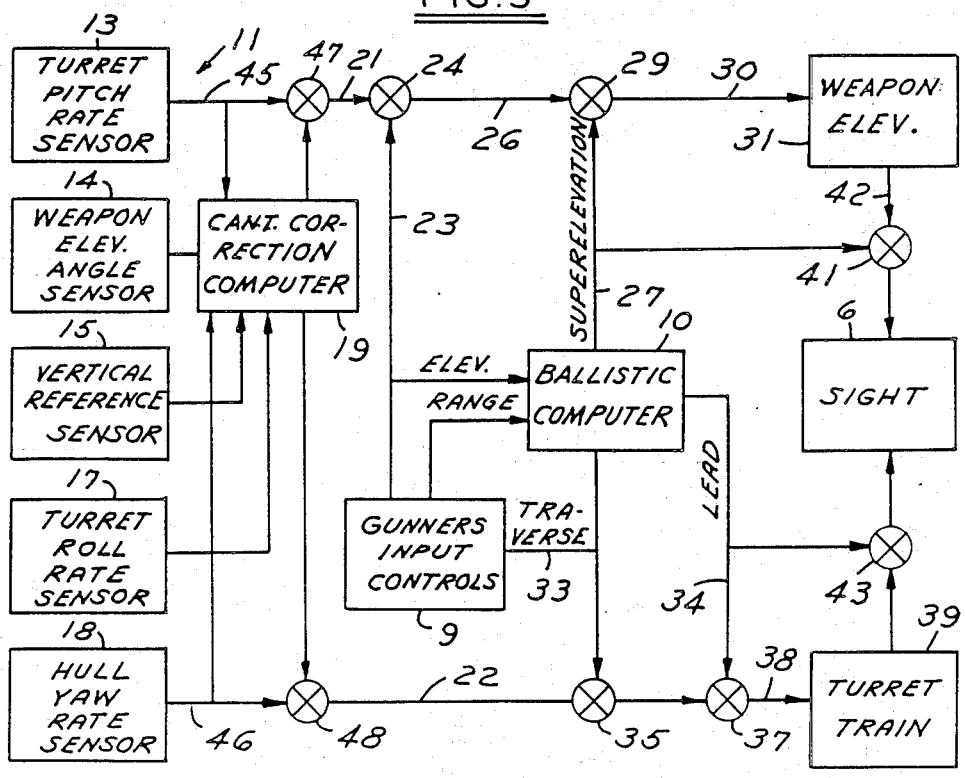
FIG. 3 is a schematic diagram of a gun control system for a tank.

Referring now to the schematic diagram of FIG. 3, the elements there shown are mounted in the tank 1. A predominantly electrical control system is disclosed. The tank gunner operates suitable input controls 9 by which electrical voltage signals representing target traverse rate, target elevation rate, and target range or range rate from a range finder are fed to a ballistic computer 10, the primary function of which is to compute lead and superelevation and control gun and sight aiming accordingly. Controls 9 and computer 10 may follow known practice, and the details are immaterial here.

The system also includes a stabilization system indicated generally as 11, which includes a turret pitch rate sensor 13, a weapon elevation angle sensor 14, a vertical reference sensor 15, a turret roll rate sensor 17, a hull yaw rate sensor 18, and a cant correction computer 19. We will omit for now any discussion of the stabilization system 11 except to state that it provides an elevation stabilization signal indicated at 21 and a train stabilization signal at 22. In the particular gun control system here described, these signals are electrical signals the potential and polarity of which define the rate and direction of change of elevation and train respectively of the line of aim of the gun sight due to yaw, roll and pitch of the tank.

The signal in line 21 is algebraically added to the gunner's train signal on line 23 in a differential device 24; in this case, an electrical adding circuit with output to a line 26. As noted above, line 23 also feeds the ballistic computer 1. This computer delivers on line 27 a superelevation rate signal which determines elevation of the gun bore relative to the line of sight. The signals on lines 26 and 27 are added at 29 to provide the gun elevation controlling rate signal on line 30 to the weapon elevation drive 31. This signal is processed in the circuits of FIG. 4, to be described, to cause the rate (plus or minus) of elevation of the gun relative to the tank hull to vary as the sum of line of sight elevation rate, ballistic factors, and the stabilization input rate.

The train signal to the turret 3 is handled similarly. The traverse rate signals on line 22 from the stabilization system, on line 33 from the gunner's control, and on line 34 from the ballistic computer, are summed in adders 35 and 37 to provide train rate input 38 to the turret train drive 39. The control 9 transmits line of sight change, the computer 10 generates change of lead, and the input on 22 acts to nullify the effect of hull yaw, pitch, and roll.

The gun sight must also be stabilized and must move consonantly with the gun. This is illustrated schematically as follows: Gun superelevation on line 27 is subtracted by a differential device 41 from gun elevation transmitted by line 42, and the resultant signal controls sight elevation by means the nature of which is immaterial. Gun leads on line 34 is subtracted at 43 from turret train to control sight azimuth, as illustrated. Actually, if the sight is on the turret, train enters the sight base, and it is necessary only to subtract the lead angle input.

While we are not concerned in this application with principles and structure of the stabilization system 11, it may be desirable to explain it further.

The turret pitch rate sensor 13 measures the rate of rotation of the turret 3 about the gun elevation axis, and thus the rate of change of gun elevation. This is fed to the gun and to the cant correction computer 19 through line 45.

The hull yaw rate sensor 18 measures the rotational velocity of the tank hull 2 about the yaw axis, which is a component of actual gun train order, and is fed to the gun and to the cant correction computer through line 46.

The cant correction computer 19 provides a correction to the line of sight to counter the effects of tilt (pitch or roll) of the turret. The need for this may be seen from the fact that, if the turret is tilted, the line of sight will be displaced, and the necessary correction is a function of the two inputs from sensors 13 and 18 and of three other parameters.

Weapon elevation angle sensor 14 supplies this quantity (with respect to the turret) to computer 19. Vertical reference sensor 15 provides a sense of true vertical to resolve the other input into components. The turret roll rate sensor measures rate of roll of the turret about an axis normal to the elevation axis of the gun. These five inputs to the cant correction computer determine, by means immaterial here, cant corrections to the stabilization signals. These are combined in adding differentials 47 and 48 to provide the final stabilization signals on lines 21 and 22, respectively. These signals hold the gun sight on target by counteracting gyrations of the tank (or other platform) and supply corresponding corrections to the gun train and elevation drives.

To conclude, the system diagrammed on FIG. 3 provides signals to control movement of the gun and sight relative to the tank hull. These signals are d.c. signals, the potential representing rate and the polarity determining direction. By way of illustration, in the preferred embodiment, one volt d.c. represents 0.1 radian per sec. angular velocity.

Figure 4:
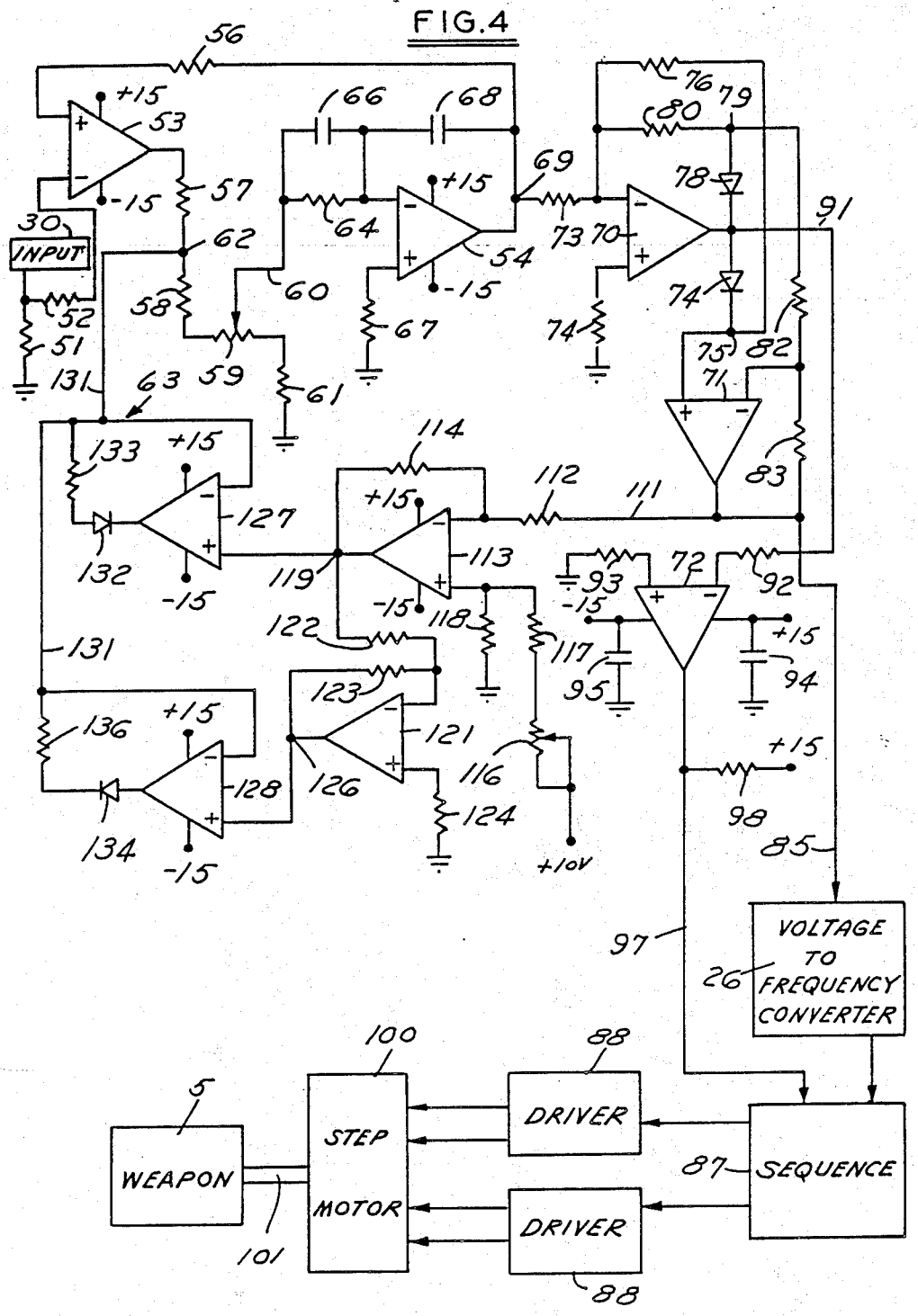
FIG. 4 is a schematic diagram of the control circuits for a stepping-motor drive.

This brings us to the circuit for optimum control of a train or elevation stepping motor illustrated in FIG. 4. In this figure, the input is indicated as 30, the analog input of d.c. voltage proportional to desired angular velocity (in elevation, in this case). For train, the same circuit is used with input 38. The input is grounded through 10K (kilohm) resistor 51 and connected by 1K resistor 52 to the inverting input of operational amplifier (hereafter opamp) 53. An opamp is a differential amplifier of high input impedance. The opamp is energized from plus and minus 15 v.d.c. sources as indicated. The non-inverting input of 53 receives a feedback from a succeeding opamp 54 through a 1K resistor 56.

The output of opamp 53 is grounded through 3.3K resistor 57, 3.74K resistorr 58, 5K potentiometer 59 and 1.24K resistor 61. A junction 62 in this series is connected to a limiting circuit 63 to be described. The slide of potentiometer 59 connects through line 60 to the inverting input of opamp 54 through 100K resistor 64 in parallel with 2200 pF capacitor 66. The non-inverting input is grounded by 100K resistor 67. The output terminal feeds back through 1 microfarad capacitor 68 to the inverting input. Opamp 54 acts as an integrator to limit the rate of change of voltage with respect to time at junction 69. The action of limiting circuit 63 provides an exponential response to input transients and thus limits acceleration of the stepping motor. Maximum acceleration rate is set by the potentiometer 59, which transmits a variable fraction of output potential of limiter 63. Under steady state conditions, the potential at 69 equals that at input 30.

From junction 69, the signal proceeds through a circuit comprising opamps 70, 71 and 72. This generates a first output (magnitude irrespective of polarity) and a second output responsive to polarity of the input. These are then applied to control speed and direction, respectively, of the stepping motor.

Junction 69 connects through 10K resistor 73 to the inverting input of opamp 70, the non-inverting input being grounded by 4.09K resistor 74. The output of opamp 70 is connected to its inverting input by two parallel paths: one through anode-cathode of diode 74, junction 75, and 10K resistor 76, the other through cathode-anode of diode 78, junction 79, and 10K resistor 80. As a result, junction 75 is always positive with respect to junction 79 causing the voltage on line 111 to equal the absolute value of the input voltage transmitted through junction 69.

Junction 75 is connected to the non-inverting input of opamp 71, and junction 79 to its inverting input and output through 10K resistors 82 and 83 as shown. The output of opamp 71 is connected by line 85 to a voltage-to-frequency converter 86, a known commercial device which generates pulses of a frequency proportional to the absolute emf on line 85. This forms part of the stepping motor installation, to be described. Motor speed is determined by pulse frequency. It should be noted that amplifiers 70, 71 operate in conjunction to form an absolute value of voltage at junction 69.

Direction of motor rotation is determined by a sequencer 87 which receives pulses from the converter 86 and transmits them to two motor driver circuits 88. The sequencer determines the sequencing of the pulses to the drivers and thus the direction of rotation of the stepping motor.

The sequencer is controlled in response to the polarity of the output of opamp 70, which indicates the polarity of the input 30. This output connects through line 91 and 1K resistor 92 to the inverting input of opamp 72. The non-inverting input is grounded through 1K resistor 93. The 15 V plus and minus supplies are grounded through 0.1 microfarad capacitors 94 and 95. The output is connected through line 97 to the sequencer, and through 10K resistor 98 to plus 15 V supply. Depending upon the polarity of line 91, line 97 is maintained at plus 15 V or zero, thus providing an unambiguous signal to the sequencer to determine the sequencing of motor drive pulses and thus direction of motor rotation.

The sequenced pulses from the sequencer 87 turn on the drivers 88 which feed power to the windings of the stepping motor 100 which drives the weapon such as gun 5 in train or elevation through any suitable connection, indicated diagrammatically by a shaft 101. Elements 86, 87, 88, and 100 constitute a purchasable system, the details of which are immaterial to this disclosure.

It is important, however, that the inputs to the motor be kept within its capacity. The stepping motor system preferably used has an acceleration capability which decreases as motor speed increases. This brings us to a significant limiting circuit to trim motor input to its capability. It acts by limiting the speed command to the motor by means now to be described.

This effect depends upon a limiting or clamping circuit controlling the input to the amplifier 54, in conjunction with the integrating action of this amplifier. This limiting circuit receives an input of motor speed command through a branch 111 of line 85 and 20K resistor 112 to the inverting input of opamp 113. This input is coupled to the output through 10K resistor 114.

The non-inverting input of opamp 113 is energized from an accurately controlled plus 10 volt source through potentiometer 116 and resistor 117, and grounded through resistor 118, all 10K. Potentiometer 116 is a speed limit adjustment for the motor control. It affords a range from $+3\frac{1}{3}$ V to $+5$ V at the non-inverting input of opamp 113. The output of the opamp is a positive voltage corresponding to the difference between the speed limit set by resistance of potentiometer 116 and the commanded motor speed which is proportional to the voltage on line 111.

The output emf of opamp 13 at junction 119 is fed to the inverting input of an opamp 121 through 10K resistor 122, and the input connects to the output through 10K resistor 123. The non-inverting input of this opamp is grounded through a 4.99K resistor 124. Opamp 121 serves simply as an inverter, delivering a negative potential at junction 126 of the same magnitude as the positive potential at junction 119.

These two potentials are applied to opamps 127 and 128, respectively, which act to set the plus and minus limits of the output from opamp 53. Junctions 119 and 126 are directly connected to the non-inverting inputs of these opamps. Both inverting inputs are directly connected by line 131 to junction 62 in the output circuit of opamp 53. The output of opamp 127 is connected through diode 132 cathode-to-anode and 1K resistor 133 to line 131. The output of opamp 128 is connected to line 131 through diode 134 anode-to-cathode and 1K resistor 136.

When the potential on line 131 is lower positively than that on junction 119, opamp 127 provides a positive output which is blocked by diode 132. However, when line 131 reaches the plus level of junction 119, the opamp output is negative, and junction 131 is drained through the low resistance 133 and forward-biased diode. As noted, potential at 119 is a linear inverse function of the speed signal on line 111 which controls the stepping motor; more particularly, a positive voltage corresponding to the difference between the speed limit set by potentiometer 116 and the command motor speed on line 111. Thus, the higher the motor speed, the lower is the maximum signal that can be supplied from junction 62 to the integrating opamp 54. This limitation on integrator output limits the rate of change of the speed signal to the stepping motor.

The clamping action of opamp 128 limits acceleration in the reverse direction in the same way. Since the emf at junction 126 is the inverse of that junction 119, and the diode 134 is forward-biased away from the opamp, this acts as a negative limit decreasing with motor speed.

Thus, acceleration signals to the stepping motor cannot swing beyond predetermined limits decreasing with motor speed. The datum of these limits is adjustable by potentiometer 116. The rate of decrease of acceleration limit with speed is determined by the relative values of resistors 112 and 114.

By limiting rate of increase of the speed signals to the stepping motors driving the weapon in train and elevation, stalling or dropout of the drive system resulting from abrupt inputs is prevented. Such abrupt inputs may obviously occur in a vehicle traversing rought terrain. If a sudden tilt of the vehicle exceeds the response capability of the gun drive, the gun and gunsight will simply deviate temporarily from the target until the error can be corrected within the pace tolerable by the machine. This temporary deviation will be apparent to the gunner, who can withhold fire until it is corrected.

The gunner provides inputs of target movement, and the stabilization system, and the ballistic computer, working in conjunction, control the weapon and sight in accordance with necessary stabilization and ballistic inputs.

It should be apparent that the result is a self-contained fire control system of superior capabilities. It will also be apparent that the invention may be embodied in modifications of the preferred embodiment described herein.

I claim:

1. A control system for establishing a line of fire for a weapon mounted on a vehicle subject to rotational movements about axes oblique to the line of fire of the weapon and for stabilizing the weapon, the system including sighting means operable to define the direction of the line of sight to a target as signals of train and elevation of the sight relative to the vehicle, stabilizing means operative to generate signals counteracting the effect of said rotational movements, means for applying the stabilizing signals to the signals established by the sighting means to provide weapon train and elevation signals for control of the line of fire of the weapon, and a transmission system for each of the weapon train and elevation signals each transmission system including a pulse generating means effective to generate pulses at a frequency proportional to the rate of change of the signal and a stepping motor drivingly coupled to the weapon and driver by the said pulses.

2. An aiming system for a weapon mounted on a vehicle subject to rotational disturbances comprising, in combination, a sight, input controls operable by an operator to generate train and elevation rate signals, ballistic computer means responsive to the said signals effective to generate outputs of train and elevation rate for transmission to the weapon, an output of train rate corrected for lead for transmission to the sight, and an output of elevation rate corrected for superelevation for transmission to the sight, and stabilization means effective to modify the said outputs to counteract the effect of vehicle rotational disturbances, the stabilization means providing train and elevation rate signals, means for combining the stabilizatin rate signals with the rate signals from the input controls and the ballistic computer to provide an analog train rate signal and an analog elevation rate signal, stepping motor drives providing train and elevation inputs to the weapon, each stepping motor drive comprising a pulse generator and a weapon drive motor actuated by pulses from the pulse generator, and conversion means effective to command the rate of pulses generated in the pulse generators of the stepping motor drives, the conversion means being directly responsive to the said analog signals.

* * * * *